US009490539B2

(12) United States Patent
Ito

(10) Patent No.: US 9,490,539 B2
(45) Date of Patent: Nov. 8, 2016

(54) ANTENNA DEVICE, INFORMATION PROCESSING DEVICE, AND STORAGE DEVICE

(71) Applicant: KABUSHIKI KAISHA TOSHIBA, Minato-ku, Tokyo (JP)

(72) Inventor: Takayoshi Ito, Yokohama Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 14/743,003

(22) Filed: Jun. 18, 2015

(65) Prior Publication Data

US 2015/0372386 A1 Dec. 24, 2015

(30) Foreign Application Priority Data

Jun. 18, 2014 (JP) ..... 2014-125415

(51) Int. Cl.

| | |
|---|---|
| ***H01Q 21/00*** | (2006.01) |
| ***H01Q 9/04*** | (2006.01) |
| ***H01Q 9/16*** | (2006.01) |
| *H01Q 9/14* | (2006.01) |
| *H01Q 11/08* | (2006.01) |
| *H01Q 15/00* | (2006.01) |
| *H01Q 21/06* | (2006.01) |
| *H01Q 9/30* | (2006.01) |
| *H01P 5/04* | (2006.01) |

(52) U.S. Cl.

CPC ..... *H01Q 9/0407* (2013.01); *H01Q 9/0457* (2013.01); *H01Q 9/16* (2013.01); *H01Q 21/065* (2013.01); *H01P 5/04* (2013.01); *H01Q 9/145* (2013.01); *H01Q 9/30* (2013.01); *H01Q 11/08* (2013.01); *H01Q 15/0006* (2013.01); *H01Q 21/061* (2013.01); *H01Q 21/062* (2013.01); *H01R 2201/02* (2013.01)

(58) Field of Classification Search

CPC .. H01Q 21/061; H01Q 11/08; H01Q 21/062; H01Q 15/0006; H01Q 9/145; H01Q 9/30; H01P 5/04; H01R 2201/02

USPC ..... 343/893, 906, 862, 745, 749, 843, 909, 343/824

See application file for complete search history.

(56) References Cited

U.S. PATENT DOCUMENTS

2011/0128192 A1* 6/2011 Lee ..... H01Q 1/243 343/702

2014/0055939 A1 2/2014 Hashimoto et al.

FOREIGN PATENT DOCUMENTS

| | | | |
|---|---|---|---|
| JP | 10092981 | A | 4/1998 |
| JP | 2010109435 | A | 5/2010 |
| JP | 2014045247 | A | 3/2014 |

* cited by examiner

*Primary Examiner* — Joseph Lauture

(74) *Attorney, Agent, or Firm* — Holtz, Holtz & Volek PC

(57) ABSTRACT

According to an embodiment, an antenna device includes a first dielectric substance and a second dielectric substance. The first dielectric substance is internally provided with a wave source. The second dielectric substance includes a first surface on which a conductor with an opening is provided, and a second surface on which a radiation element is provided, the first surface being opposed to a counter surface of the first dielectric substance, the second surface being opposed to the first surface. The first surface of the second dielectric substance is larger than the counter surface of the first dielectric substance, and a distance between the first and second dielectric substances is smaller than or equal to twice the wavelength of a used frequency.

8 Claims, 6 Drawing Sheets

ANTENNA DEVICE, INFORMATION PROCESSING DEVICE, AND STORAGE DEVICE

CROSS-REFERENCE TO RELATED APPLICATION

This application is based upon and claims the benefit of priority from Japanese Patent Application No. 2014-125415, filed Jun. 18, 2014, the entire contents of which are incorporated herein by reference.

FIELD

Embodiments described herein relate generally to an antenna device, and information processing device and storage device using the antenna device.

BACKGROUND

An antenna device that transmits/receives an electromagnetic wave by utilizing a slot formed in a conductor layer is known. In such an antenna device, a radio-frequency current induced around the slot leaks out to an end part of the conductor layer, whereby an undesired diffraction wave is generated from the end part of the conductor layer. This diffraction wave deteriorates the antenna characteristics. In the antenna device, it is desired that the antenna characteristics can be prevented from being deteriorated.

DETAILED DESCRIPTION

According to an embodiment, an antenna device includes a first dielectric substance and a second dielectric substance.

The first dielectric substance is internally provided with a wave source. The second dielectric substance includes a first surface on which a conductor with an opening is provided, and a second surface on which a radiation element is provided, the first surface being opposed to a counter surface of the first dielectric substance, the second surface being opposed to the first surface. The first surface of the second dielectric substance is larger than the counter surface of the first dielectric substance, and a distance between the first dielectric substance and the second dielectric substance is smaller than or equal to twice the wavelength of a used frequency.

Hereinafter, embodiments will be described with reference to the drawings.

First Embodiment

Figure 1:
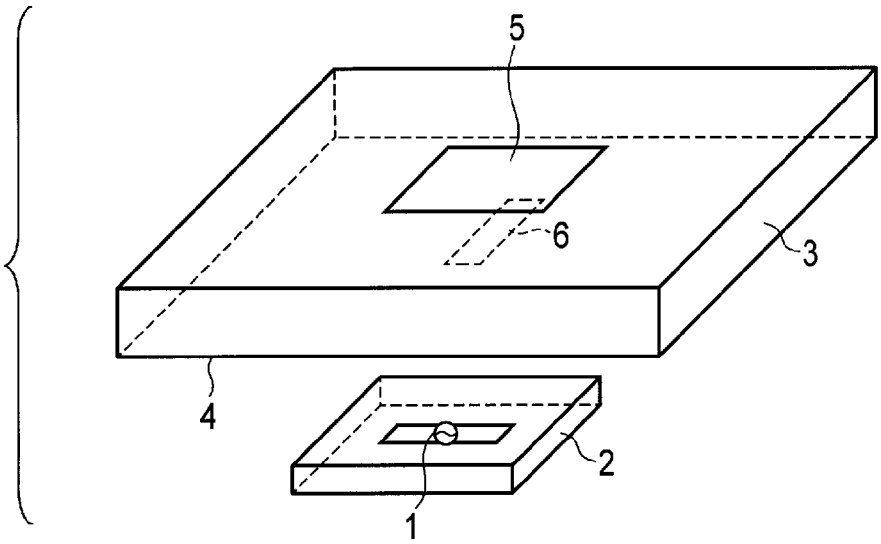
FIG. 1 is a perspective view showing an antenna device according to a first embodiment.
Figure 2:
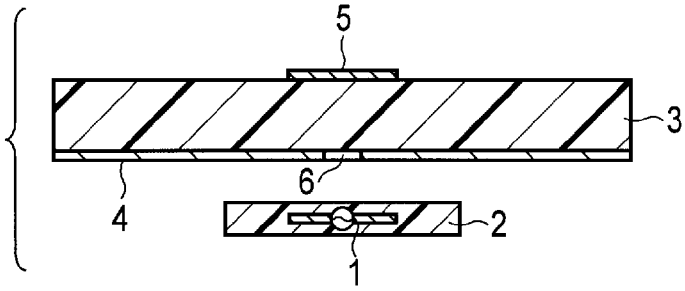
FIG. 2 is a cross-sectional view of the antenna device shown in FIG. 1.

FIG. 1 and FIG. 2 are a perspective view and cross-sectional view schematically showing an antenna device according to a first embodiment. As shown in FIG. 1, the antenna device includes a dielectric substance 2 internally provided with a wave source 1, and dielectric substance 3 in which a conductor (also called a conductor layer) 4 is provided on a first surface, and a radiation element 5 is provided on a second surface opposed to the first surface.

The wave source 1 is provided inside the dielectric substance 2. The dielectric substance 2 is, for example, a molded resin having a substantially rectangular parallelepiped-like shape. The dielectric substance 2 is mounted on an implementation substrate not shown. A radio-frequency (RF) signal is supplied to the wave source 1. The wave source 1 radiates an electromagnetic wave corresponding to the RF signal. In the example shown in FIG. 1, the wave source 1 is a dipole antenna. It should be noted that the wave source 1 is not limited to the dipole antenna, and may be another type of antenna such as a patch antenna, loop antenna, and the like.

As shown in FIG. 2, the dielectric substance 3 is arranged opposite to the dielectric substance 2. The second surface of the dielectric substance 3, i.e. the conductor 4 is opposed to the dielectric substance 2. A surface belonging to the dielectric substance 2 and opposed to the dielectric substance 3 is called a counter surface.

The dielectric substance 3 is, for example, a printed-circuit board resin having a substantially rectangular parallelepiped-like shape. At the central part of the conductor 4, a slot 6 is provided. The central part of the first surface of the dielectric substance 3 is exposed, and the remaining part of the first surface is covered with the conductor 4.

The radiation element 5 is spatially coupled with the wave source 1 through the slot 6, and receives an electromagnetic wave from the wave source 1 to radiate an electromagnetic wave to be used for communication. The slot 6 is an opening provided in the conductor 4 separating the wave source 1 and radiation element 5 from each other. The shorter the distance between the radiation element 5 and wave source 1, the stronger the space coupling between the radiation element 5 and wave source 1 is. Specifically, the shorter the distance between the wave source 1 and slot 6, the stronger the coupling between the wave source 1 and radiation element 5 is and, the shorter the distance between the slot 6 and radiation element 5, the stronger the coupling between the wave source 1 and radiation element 5 becomes. It should be noted that the wave source 1 is provided inside the dielectric substance 2, and thus the wave source 1 does not come into contact with the slot 6. Also, the slot 6 is provided in the first surface of the dielectric substance 3, and the radiation element 5 is provided on the second surface of the dielectric substance 3, and thus the radiation element 5 does not come into contact with the slot 6.

It is desirable that the radiation element 5 be provided in the near field of the wave source 1. This is because the space coupling becomes weak in the far field.

Assuming that the wave source 1 and the radiation element 5 resonate at a frequency corresponding to a half-wavelength, the boundary between the near field and far field can be expressed by, for example, the following formula (1).

$$r = \frac{2(d_1 + d_2)^2}{\lambda} \quad (1)$$

Here, $d_1$ denotes the dimension of the wave source 1, $d_2$ denotes the dimension of the radiation element 5, and $\lambda$ denotes a wavelength of the used frequency (i.e., a wavelength of the electromagnetic wave used for communication). For example, $d_1=\lambda/2$, $d_2=\lambda/2$ and, in this case, r is $2\lambda$ ($r=2\lambda$). When the distance between the wave source 1 and radiation element 5 is greater than twice the wavelength of the used frequency, the radiation element 5 is positioned in the far field of the wave source 1. In consideration of this fact, it is desirable that the distance between the dielectric substance 2 and dielectric substance 3 be made smaller than or equal to twice the wavelength of the used frequency. Specifically, the distance between the dielectric substance 2 and dielectric substance 3 implies the distance between the counter surface of the dielectric substance 2 and first surface of the dielectric substance 3.

Figure 3:
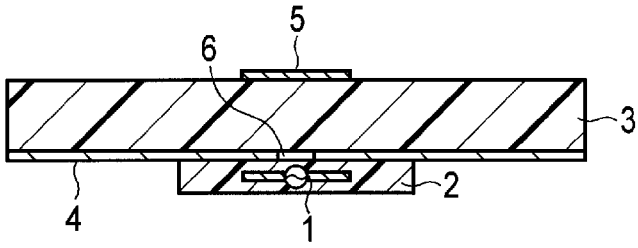
FIG. 3 is a cross-sectional view showing the antenna device according to the first embodiment in the case where dielectric substances are in contact with each other.

It should be noted that the distance between the dielectric substance 2 and dielectric substance 3 may also be zero. In this case, the dielectric substance 2 and the dielectric substance 3 are in contact with each other as shown in FIG. 3. Specifically, the counter surface of the dielectric substance 2 and the conductor 4 provided on the first surface of the dielectric substance 3 are in contact with each other.

As shown in FIG. 1, the dielectric substance 3 is larger than the dielectric substance 2. Specifically, the first surface of the dielectric substance 3 is larger than the counter surface of the dielectric substance 2. In the example shown in FIG. 1, both the first surface of the dielectric substance 3 and the counter surface of the dielectric substance 2 are rectangular, the length of the short side of the first surface of the dielectric substance 3 is greater than the length of the short side of the counter surface of the dielectric substance 2, and the length of the short side of the first surface of the dielectric substance 3 is greater than the length of the long side of the counter surface of the dielectric substance 2. When viewed from above, the whole dielectric substance 2 is hidden behind the dielectric substance 3. By making the dielectric substance 3 larger than the dielectric substance 2, it becomes possible to also make the conductor 4 larger than the dielectric substance 2. Thereby, the leakage current appearing at the end part of the conductor 4 becomes small. As a result, it is possible to reduce the undesired diffraction wave generated at the end part of conductor 4.

In the example shown in FIG. 1, the radiation element 5 is a rectangular patch element. By placing the radiation element 5 directly above the slot 6, energy is concentrated at a part around the radiation element 5, and the leakage current appearing at the end part of the conductor 4 becomes small. As a result, it is possible to reduce the undesired diffraction wave. It should be noted that the shape of the patch is not limited to the rectangle, and the radiation element 5 may be, for example, a circular patch element.

The wave source 1 is shielded by the conductor 4, and thus the radiation pattern is determined by the radiation from the radiation element 5. That is, it is possible to design the radiation pattern irrespective of the wave source 1 by designing of the external antenna substrate formed by the dielectric substance 3, conductor 4, and radiation element 5.

As described above, in the antenna device according to this embodiment, the conductor 4 is greater than the counter surface of the dielectric substance 2. Thereby, the amount of the current appearing at the diffraction point of the conductor end part is reduced, and the undesired diffraction wave is reduced. As a result, the antenna characteristics are improved.

Second Embodiment

Figure 4:
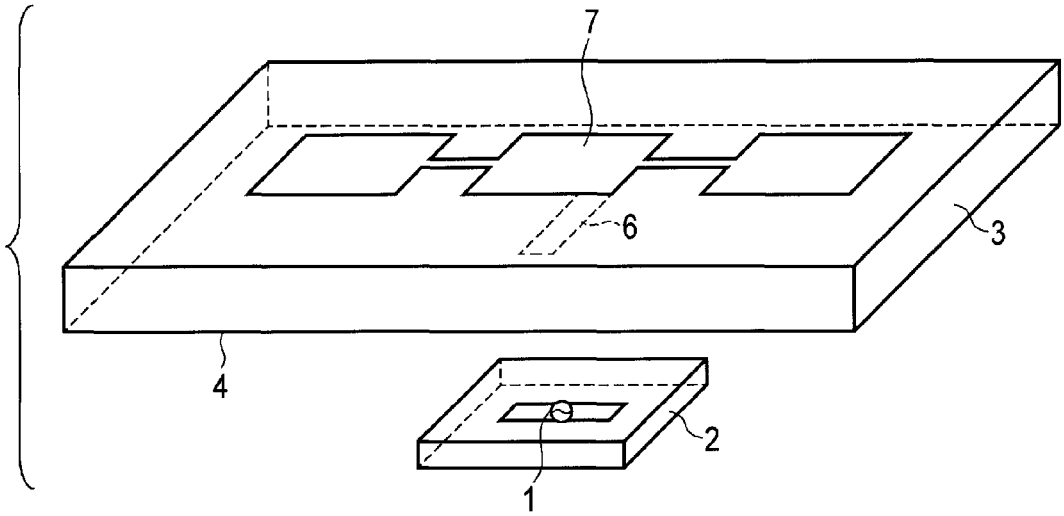
FIG. 4 is a perspective view showing an antenna device according to a second embodiment.
Figure 5:
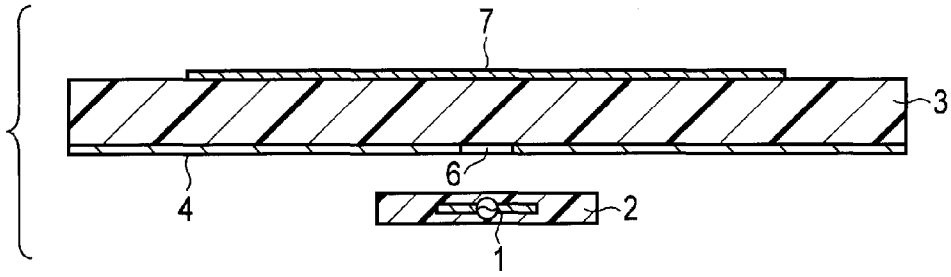
FIG. 5 is a cross-sectional view of the antenna device shown in FIG. 4.

FIG. 4 and FIG. 5 are a perspective view and cross-sectional view schematically showing an antenna device according to a second embodiment. In FIG. 4, and FIG. 5, elements identical to the elements shown in FIGS. 1 to 3 are denoted by identical reference numerals, and descriptions of those elements are omitted.

In the antenna device shown in FIG. 4, a patch-array element 7 is provided on a second surface of a dielectric substance 3. The patch-array element 7 is formed by arranging a plurality of (three in the example of FIG. 4) rectangular patch elements in series. By forming patch elements into an array, radiation energy in the desired direction is converged. Accordingly, an influence of the diffraction wave can be relatively reduced. As a result, the antenna characteristics are improved. It should be noted that the shape of the patch element is not limited to a rectangle, and may be another shape, for example, a circular shape. Also, the array configuration is not limited to a serial array, and may be a parallel array or a serial-parallel array. Furthermore, although the patch elements are directly connected to each other through partition lines, they may be spatially coupled.

Third Embodiment

Figure 6:
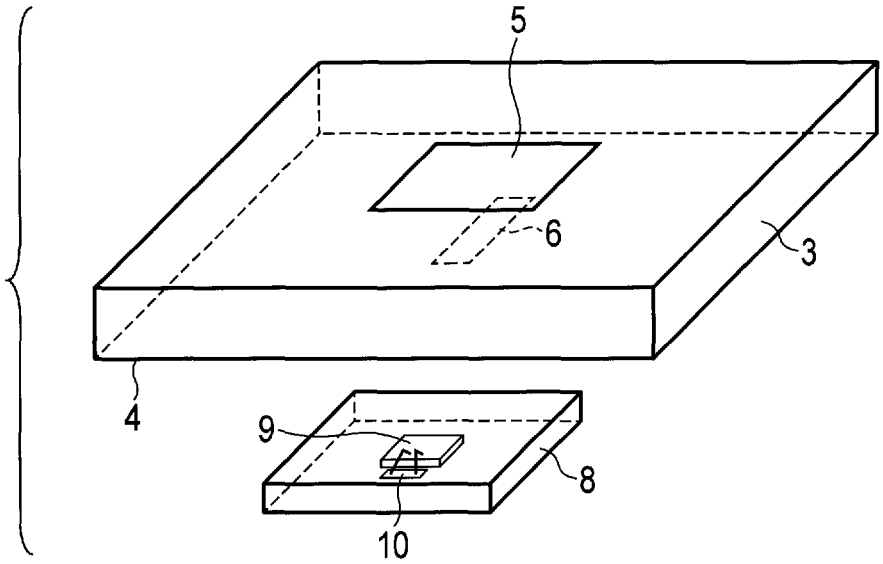
FIG. 6 is a perspective view showing an antenna device according to a third embodiment.
Figure 7:
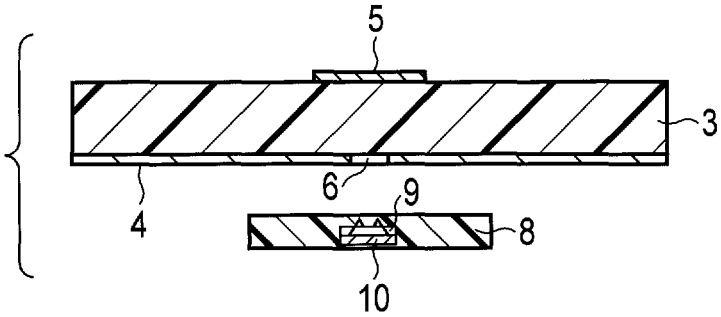
FIG. 7 is a cross-sectional view of the antenna device shown in FIG. 6.

FIG. 6 and FIG. 7 are a perspective view and cross-sectional view schematically showing an antenna device according to a third embodiment. In FIG. 6, and FIG. 7, elements identical to the elements shown in FIGS. 1 to 5 are denoted by identical reference numerals, and descriptions of those elements are omitted.

The third embodiment corresponds to an aspect in which the dielectric substance 2 (FIG. 1) according to the first embodiment is a semiconductor package. In the antenna device shown in FIG. 6, a semiconductor 9 and a wave source 10 are encapsulated in a molded resin 8. The semiconductor 9 includes a radio-frequency integrated circuit (RFIC) with a feeder circuit and the like. The wave source 10 is fed by the semiconductor 9. In this embodiment, there is no need for supplying an RF signal from the outside of the molded resin 8, and thus a diffraction wave generated by an undesired current induced by the feeder wiring can be reduced.

As shown in FIG. 7, a dielectric substance 3 is arranged opposite to the molded resin 8. The first surface of the dielectric substance 3, i.e., the conductor 4 is opposed to the counter surface of the molded resin 8. A radiation element 5 is spatially coupled to the wave source 10 through a slot 6. It is desirable that the distance between the molded resin 8 and dielectric substance 3 be made smaller than or equal to twice the wavelength of the used frequency.

As shown in FIG. 6, the dielectric substance 3 is larger than the molded resin 8. Specifically, the first surface of the dielectric substance 3 is larger than the counter surface of the molded resin 8. By making the dielectric substance 3 larger than the dielectric substance 2, it becomes possible to also make the conductor 4 larger than the dielectric substance 2. Thereby, the leakage current appearing at the end part of the conductor 4 becomes small. As a result, an undesired diffraction wave occurring at the end part of the conductor 4 can be reduced.

In the example shown in FIG. 6, the wave source 10 is a loop antenna utilizing bonding wires. It should be noted that the wave source 10 is not limited to the loop antenna, and may be another type of antenna such as a dipole antenna or the like. In addition, the wave source 10 may be formed on the semiconductor 9.

Fourth Embodiment

Figure 8:
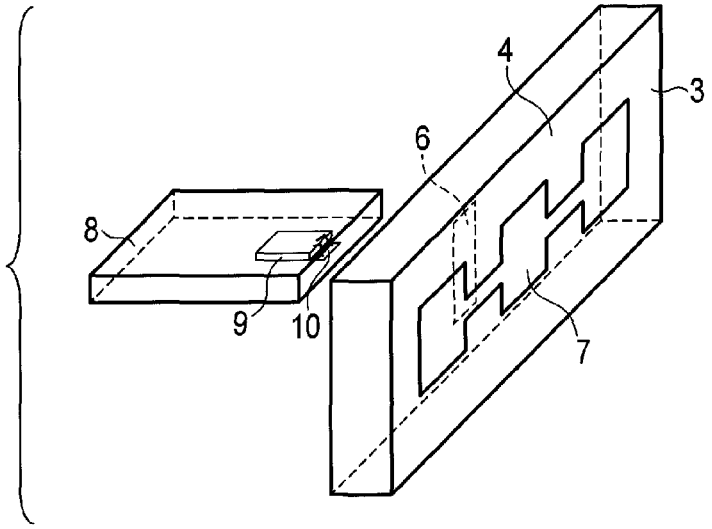
FIG. 8 is a perspective view showing an antenna device according to a fourth embodiment.
Figure 9:
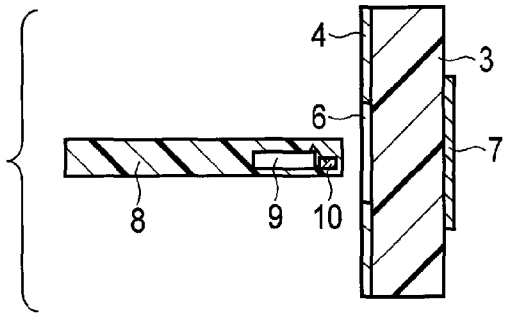
FIG. 9 is a cross-sectional view of the antenna device shown in FIG. 8.

FIG. 8 and FIG. 9 are a perspective view and cross-sectional view schematically showing an antenna device according to a fourth embodiment. In FIG. 8, and FIG. 9, elements identical to the elements shown in FIGS. 1 to 7 are denoted by identical reference numerals, and descriptions of those elements are omitted.

In the antenna device shown in FIG. 8 and FIG. 9, a semiconductor 9 is arranged close to the end part of a molded resin 8. In this case, the main radiation direction of a wave source 10 is the lateral direction. A dielectric substance 3 is arranged in the main radiation direction of the wave source 10. That is, the counter surface of the molded resin 8 is the surface positioned in the main radiation direction of the wave source 10. By arranging the dielectric substance 3 in the main radiation direction of the wave source 10, the space coupling between the wave source 10 and patch elements in patch-array elements 7 becomes the strongest. At this time, the radiation energy in the desired direction becomes large, and thus the influence of the diffraction wave can be relatively reduced. As a result, the antenna characteristics can be improved.

Figure 10:
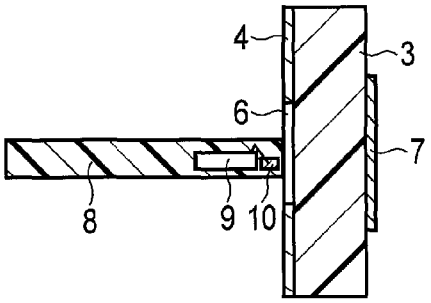
FIG. 10 is a cross-sectional view showing the antenna device according to the fourth embodiment in the case where a molded resin and dielectric substance are in contact with each other.

It should be noted that also in the fourth embodiment in which the lateral face of the molded resin 8 is opposed to the dielectric substance 3, the molded resin 8, and the conductor 4 may be in contact with each other as shown in FIG. 10.

Fifth Embodiment

In a fifth embodiment, an information processing device, and a storage device each equipped with any one of or a modified one of the antenna devices described in the first to fourth embodiments will be described.

Figure 11:
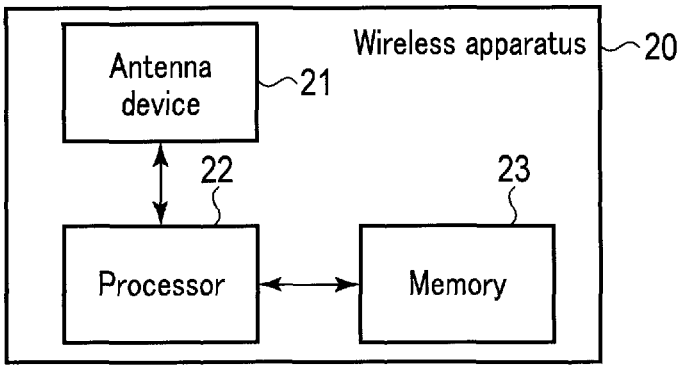
FIG. 11 is a block diagram showing an example of an information processing device equipped with an antenna device.

FIG. 11 schematically shows a wireless apparatus 20 corresponding to an information processing device according to the fifth embodiment. The wireless apparatus 20 includes an antenna device 21, processor 22, and memory 23.

The antenna device 21 is used to carry out data transmission/reception to/from the outside. The antenna device 21 can be any one of or a modified one of the antenna devices described in the above first to fourth embodiments.

The processor (also called the controller) 22 processes data received from the antenna device 21 or data to be transmitted to the antenna device 21.

The memory 23 stores data therein. Specifically, the memory 23 receives data from the processor 22 and stores therein the received data. The memory 23 provides data to the processor 22.

Next, a specific example of the wireless apparatus will be described below with reference to FIG. 12 and FIG. 13.

Figure 12:
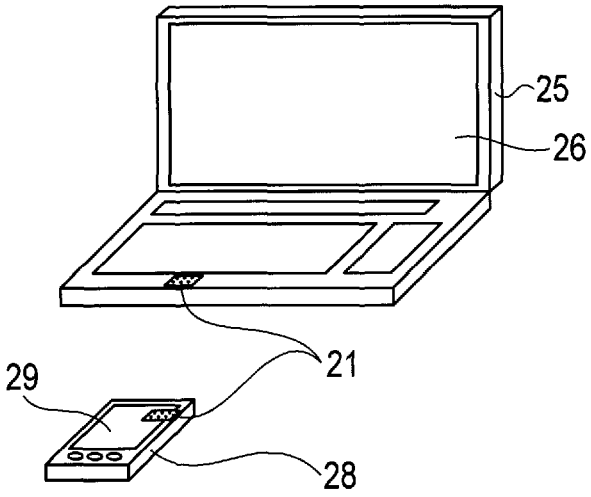
FIG. 12 is a view showing a specific example of the information processing device shown in FIG. 11.

The wireless apparatus is, for example, a notebook personal computer (PC) 25, and a portable terminal 28 shown in FIG. 12. Both the notebook PC 25 and the portable terminal 28 include display sections 26 and 29, respectively, so that the user can view a still image or a moving image. Each of these notebook PC 25 and the portable terminal 28 also includes a central processing unit (CPU) (also called a controller), memory, and the like. Each of the notebook PC 25 and the portable terminal 28 is internally or externally equipped with an antenna device 21, and carries out data communication through the antenna device 21 by using a frequency in, for example, the millimeter waveband.

Figure 13:
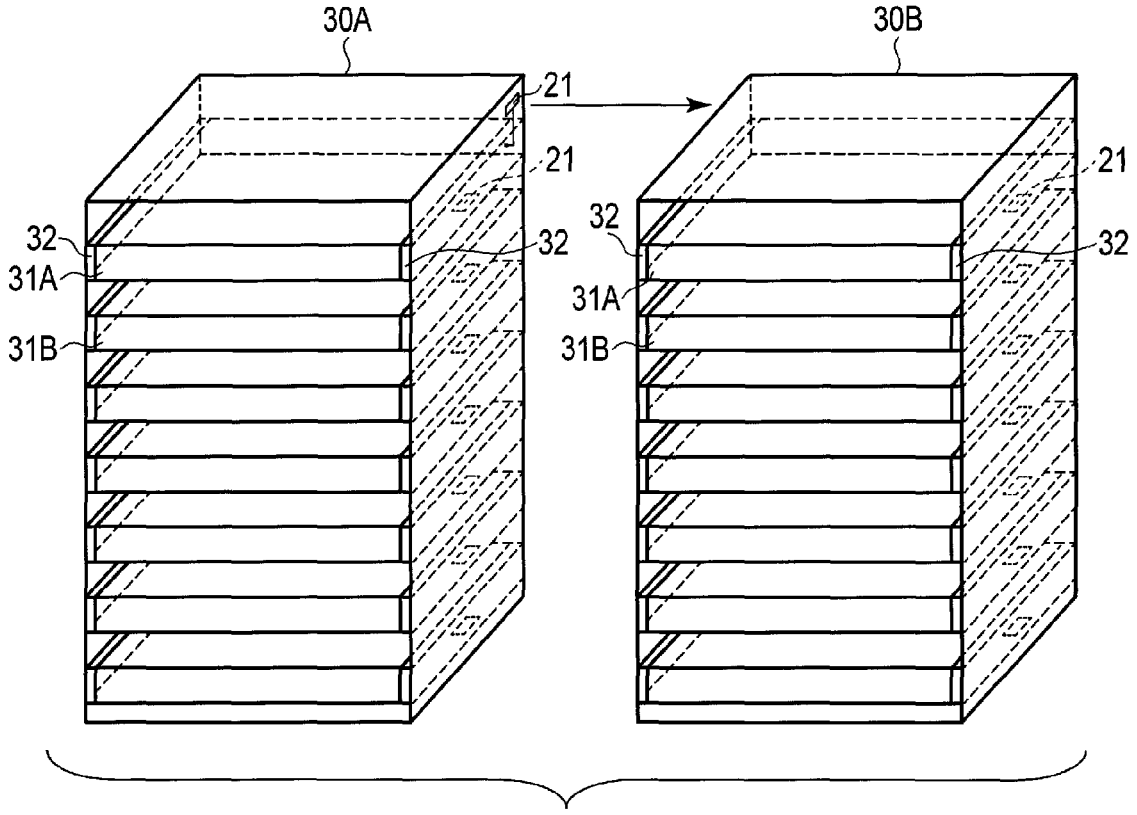
FIG. 13 is a view showing a specific example of the information processing device shown in FIG. 11.

FIG. 13 schematically shows a rack server group to be installed in a data center. As shown in FIG. 13, each of racks 30A and 30B is provided with a plurality of rack servers. A rack server 31A, which is one of the plurality of rack servers, is supported and fixed on an inner wall of the rack 30A by supporting members 32. The rack server 31A is provided with an antenna device 21, CPU, and memory. The antenna device 21 is attached to a lower part of the housing of the rack server 31A for transmission of data to a rack server 31B arranged below. Also, another antenna device 21 is attached to a side wall of the rack 30A, and the rack server 31A can transmit data to a rack server of the adjoining rack 30B by using the antenna device 21.

Next, a storage device equipped with an antenna device will be described below with reference to FIG. 14.

Figure 14:
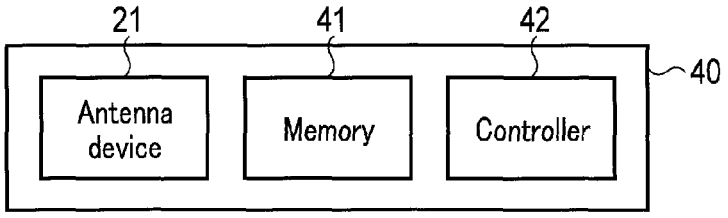
FIG. 14 is a block diagram showing another example of an information processing device equipped with an antenna device.

FIG. 14 schematically shows a solid state drive (SSD) 40 which is an example of a storage device. As shown in FIG. 14, the SSD 40 includes an antenna device 21, a memory 41 configured to store information therein, and a controller (also called a controller) 42 configured to control the whole device. The SSD 40 can carry out wireless communication with an external device through the antenna device 21.

As has been described above, according to the fifth embodiment, each of the information processing device, and the storage device such as the notebook PC, portable terminal, SSD, and the like configured to carry out data communication by wireless is equipped with any one of or a modified one of the antenna devices described in the first to fourth embodiment, whereby it is possible to carry out transmission/reception of data or the like with a high degree of efficiency.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna device comprising:

a first dielectric substance internally provided with a wave source; and a second dielectric substance including a first surface on which a conductor with an opening is provided, and a second surface on which a radiation element is provided, the first surface being opposed to a counter surface of the first dielectric substance, the second surface being opposed to the first surface, wherein the first surface of the second dielectric substance is larger than the counter surface of the first dielectric substance, and a distance between the first dielectric substance and the second dielectric substance is smaller than or equal to twice a wavelength of a used frequency.

2. The device according to claim 1, wherein the radiation element is a patch element.

3. The device according to claim 1, wherein a plurality of radiation elements formed into an array are provided on the second surface.

4. The device according to claim 1, wherein the first dielectric substance is a semiconductor package.

5. The device according to claim 1, wherein the counter surface of the first dielectric substance is a surface positioned in a main radiation direction of the wave source.

6. The device according to claim 1, wherein the counter surface of the first dielectric substance is in contact with the conductor.

7. An information processing device comprising:

the antenna device according to claim 1;

a controller configured to process data to be exchanged with the antenna device; and a memory configured to store the data.

8. A storage device comprising:

the antenna device according to claim 1;

a controller configured to process data to be exchanged with the antenna device; and a memory configured to store the data.

* * * * *